US010561898B1

(12) United States Patent
Flythe

(10) Patent No.: US 10,561,898 B1
(45) Date of Patent: Feb. 18, 2020

(54) GAIT ASSISTIVE DEVICE

(71) Applicant: Jimmie Flythe, Highland Village, TX (US)

(72) Inventor: Jimmie Flythe, Highland Village, TX (US)

( * ) Notice: Subject to any disclaimer, the term of this patent is extended or adjusted under 35 U.S.C. 154(b) by 0 days.

(21) Appl. No.: 15/837,886

(22) Filed: Dec. 11, 2017

Related U.S. Application Data

(60) Provisional application No. 62/432,686, filed on Dec. 11, 2016.

(51) Int. Cl.

| | |
|---|---|
| ***A63B 23/04*** | (2006.01) |
| ***A63B 21/02*** | (2006.01) |
| ***A63B 21/04*** | (2006.01) |
| ***A63B 23/035*** | (2006.01) |
| ***A63B 21/00*** | (2006.01) |

(52) U.S. Cl.
CPC ..... *A63B 23/0458* (2013.01); *A63B 21/023* (2013.01); *A63B 21/0428* (2013.01); *A63B 21/4034* (2015.10); *A63B 23/03508* (2013.01); *A63B 23/0464* (2013.01); *A63B 2208/0204* (2013.01)

(58) Field of Classification Search
CPC ..... A63B 21/4034; A63B 21/4043; A63B 22/20–203; A63B 23/03508; A63B 23/0458; A63B 23/0464; A63B 23/10; A61H 1/0262
See application file for complete search history.

(56) References Cited

U.S. PATENT DOCUMENTS

| | | | | | |
|---|---|---|---|---|---|
| 1,911,390 | A * | 5/1933 | Pullman | A61H 1/0266 | 482/79 |
| 3,292,612 | A * | 12/1966 | Foss | A63B 23/10 | 601/27 |
| 5,127,892 | A * | 7/1992 | Sawdon | A63B 22/20 | 482/79 |
| 5,413,543 | A * | 5/1995 | Drago | A63B 23/085 | 482/123 |
| 9,750,980 | B1 * | 9/2017 | Khalili | A63B 26/003 | |
| 2006/0116246 | A1 * | 6/2006 | Hankin | A61H 1/003 | 482/51 |
| 2015/0111705 | A1 * | 4/2015 | Walker | A63B 26/00 | 482/66 |

* cited by examiner

*Primary Examiner* — Jennifer Robertson
(74) *Attorney, Agent, or Firm* — Jeffrey Roddy

(57) ABSTRACT

A system for gait training which includes a slidable assembly for attaching to the foot with or without a shoe, on the affected side of a subject. When the subject shifts his or her body weight away from the affected side, the slidable assembly is capable of forward and backward movement to follow the swinging movement of the leg. When the subject shifts their body weight to the affected side and thereby applies weight to his or her swinging leg and the slidable assembly, a passive braking system is automatically actuated arrests any further movement of the affected limb.

3 Claims, 7 Drawing Sheets

10
12
20
21
22

FPR
14
16
21

GAIT ASSISTIVE DEVICE

CROSS REFERENCE TO RELATED APPLICATIONS

This Non-Provisional Application claims the benefit to U.S. Provisional Application No. 62/432,686, entitled "Gait Assistive Device" and filed Dec. 11, 2016.

FIELD OF THE INVENTION

The present invention relates generally to a system for assisting subjects with impaired mobility in regaining, to the extent possible, a natural gait.

BACKGROUND OF THE INVENTION

Gait is defined as the manner or style of walking. Gait Analysis refers to the evaluation of certain gait characteristics. The normal forward step consists of two phases: the stance phase in which one leg and foot are bearing most or all of the body weight, and the swing phase in which the foot is not touching the walking surface and the body weight is supported by the other leg and foot. In a complete two-step cycle, that portion of time that both feet are in contact with the floor; about 25% of the time, is called the double-support phase.

Many individuals suffer from various conditions that do not allow the advancement of a limb because of weakness or lack of motor control which causes disturbances to the normal gait pattern. One such condition causing disruptions to the normal gait pattern is hemiparesis, which is characterized by weakness on one side of the body. As many as 88% of subjects with acute stroke have hemiparesis. Physical therapists work with stroke subjects to improve awareness and use of the affected side. Current practice is to initiate physical therapy (PT) as soon as practicable after the stroke because the adaptive ability of the brain to compensate with regard to the locomotor system diminishes over time. PT involves exercises to increase range of motion and strength, and retrain motor skills such as bed mobility, transferring, walking and other gross motor functions. Retraining often utilizes assistive devices such as walkers, canes and occasionally, orthotics. Although gait training seeks to regain as much of the subject's premorbid leg mobility as possible, current assistive devices can discourage or actively prevent the use of certain motor groups of the lower extremities (LE) which would otherwise be useful in normalizing gait patterns. Because current gait training devices isolate certain muscular groups, one of the major drawbacks is that maladaptive gait habits may be inadvertently reinforced by such devices.

It would be desirable to provide a gait training system and method for gait challenged subjects regardless of etiology, that safely encourages the use of all relevant muscular groups under the supervision of a physical therapist so as to avoid compromising the subject's ability to normalize their gate.

It would be desirable for such a system and method to naturally integrate with the subject's own movements of lifting a foot, moving the leg forward or backward, and setting the foot down again to arrest forward motion.

It would be additionally desirable for such as system and method to be used independently of clinical supervision once the subject is physically capable of the transition.

SUMMARY OF THE INVENTION

The present invention assists with swing motion training and advancement of the affected limb until the leg is sufficiently strong and coordinated to enable normal lift and swing while walking, and includes an apparatus having a slidable assembly with passive braking functionality, wherein the braking function is experienced automatically by the subject during gait training exercises without any active or concerted effort outside of the necessary side to side weight shifting that accompanies a normal gait. The system also includes a method for using the apparatus in a clinical setting. A sliding member of the slidable assembly is generally flat, being constructed of any material, such as metal, wood, plastic, composite, or any combination of the foregoing, sufficient to support the weight of a human being and slide along a flat or smooth surface when moved by the motion of a subject's foot. In the particular embodiment described herein, the sliding member is a rigid or resilient plate that possesses a surface that is slidable when in contact with a floor surface and possesses one or more passageways for the passing through of one or more braking members. The slidable member may be covered with materials having different coefficient of friction for contact with the floor such as felt or various types of plastics or resins. Adjacent to the sliding member is a foot placement member that is sized and shaped to provide a foot placement member for the bottom portions of a foot. Disposed between the foot placement member and the slidable member is one or more suspension members that may be a coil spring, a rubber shock absorber, an elastomeric grommet, a leaf spring or any suitably compressive component that permits the foot placement member to move toward the slidable member when the slidable member is prevented from further downward movement, i.e., the slidable member is on the floor, and, the foot placement member is depressed. Accordingly, pneumatic, hydraulic, rubber disks and other known types of suspension are considered to be encompassed by this disclosure. In addition to the foot placement member, one or more braking members are downwardly movable when (1) the sliding member is placed on the floor, and (2) sufficient downward force is applied to the foot placement member to which the one or more braking members are linked. When the braking members move downwardly, the braking members contact the floor, thus stopping any sliding movement of the slidable member across the floor. The amount of weight required for the braking members to contact the floor depends on the stiffness of the suspension members. Accordingly, suspension members of whatever configuration may be swapped out or substituted to provide more or less resistance against downward movement of the braking members. The one or more braking members are configured to move past or transversely through the slidable member. In the particular embodiment disclosed, the slidable member includes least one passageway that permits the passing through of one or more braking members to an extent that it contacts a floor surface. In the embodiment depicted herein, alignment of the foot placement member and the slidable member is accomplished by alignment posts that extend upwardly from the slidable member, and which are shown encircled (FIGS. 3*a*-3*c*) by one or more shock absorbing members in a coaxial arrangement. It is possible that alignment between the foot placement member and the slideable member may be accomplished by a flange or lip extending from the slidable member disposed around portions of the foot placement member, such that the slidable member and foot placement member remain aligned through a gait cycle. Accordingly, the shock absorber member(s) are not necessarily circumjacent the alignment members, and may be separated from same. While in the embodiment depicted herein, the alignment posts fall outside the foot placement region shown in dashed line, it is conceivable that in some embodiments, the alignment members may be placed beneath the foot placement region. Relatedly, the passageways may be outside and adjacent the foot placement region, or beneath the foot placement region. In some embodiments, the braking members may be comprised wholly or partially of a slip resistant material, e.g., synthetic or natural rubber with sufficient grip to stop any sliding movement of the slidable member when the braking members are forced into contact with the floor.

Passive braking of the apparatus of the invention is accomplished when a subject, wearing the apparatus on the foot of his or her affected side, commences to slide the slidable member of the assembly across a floor surface while shifting his or her weight to the opposing (unaffected) leg, and thus relieving weight, i.e., downward force, from the foot placement region of the foot placement member. When the subject transfers or shifts body weight gradually or abruptly back to the affected side, the foot placement member is depressed and the one or more braking members contact the floor thus arresting the forward motion of the slidable member. No conscious effort is required by the subject when following a prescribed gait pattern as shown in (FIG. 11). The lack of conscious effort enables the subject to focus on walking rather than fear of falling, and the passive braking inhibits the subject from slipping when naturally shifting weight is applied to and from the affected side during a gait cycle. The effortless braking promotes confidence in the subject for his own ability to safely ambulate which is important for the subject's self image and therapeutic outcomes.

In one exemplary use of the invention, a physical therapist first adjusts or compensates for the height difference of the foot placement member relative to the soled or un-soled foot of the subject's unaffected side. The therapist then assists the subject to a standing position in which the foot of the affected side is placed on top of the foot placement member and secured thereto by straps. With the assistance of the therapist, forward ambulation, and optionally backward ambulation; e.g., to assist a subject in backing into a seated position, is accomplished by the subject by (1) shifting body weight away from the affected side (2) swinging the affected leg in the desired direction and then (3) shifting the weight back to the affected side. When weight is initially shifted away from the affected side, the foot placement member is caused to rise slightly by expansion of the suspension members which reside between the foot placement member and the slidable member which disengages the braking members and permits the assembly to slide freely forward or backward. When weight is shifted to the affected side, the foot placement member depresses, forcing the braking members into contact with the floor where they serve to arrest any sliding movement of the assembly. One important aspect of the passive braking is the lack of an overly complex mechanism to arrest motion. Moreover, the weight actuated braking of the instant invention is analogous to that of normal ambulation in which body weight is naturally alternated from side-to-side without requiring articulated movement of the feet; e.g., pointing the toes, lifting the toes or heeling. Among other salient aspects of the invention is the encouragement of use of a greater range of LE muscles than other gait training tools.

In a first aspect of the present invention, a system of gait training includes a slidable assembly attached to the affected side foot of a hem iparetic subject encouraging the use of both major and minor muscle groups associated with the LE.

In a second aspect of the present invention, the slidable assembly further permits both forward and backward movement of the leg of the affected side attached thereto while performing gait training exercises.

In a third aspect of the present invention, a gait training apparatus with passive braking means mimics the natural tendency of a leg to cease movement when weight is completely shifted thereto, wherein braking members are caused to contact a floor surface during weight shift which arrests any sliding movement.

In a fourth aspect of the present invention the slidable assembly is configured for use with or without the physical support of the therapist.

It should be understood that any aspect of the present invention may be combined with any other aspect. Accordingly, the description as follows is not intended to limit the scope of the invention to the particular forms set forth, but on the contrary, is intended to cover such alternatives, modifications, combinations and equivalents as may be included within the spirit and scope of the invention as set forth in the detailed description.

DETAILED DESCRIPTION OF THE INVENTION

Reference Listing

Figure 1:
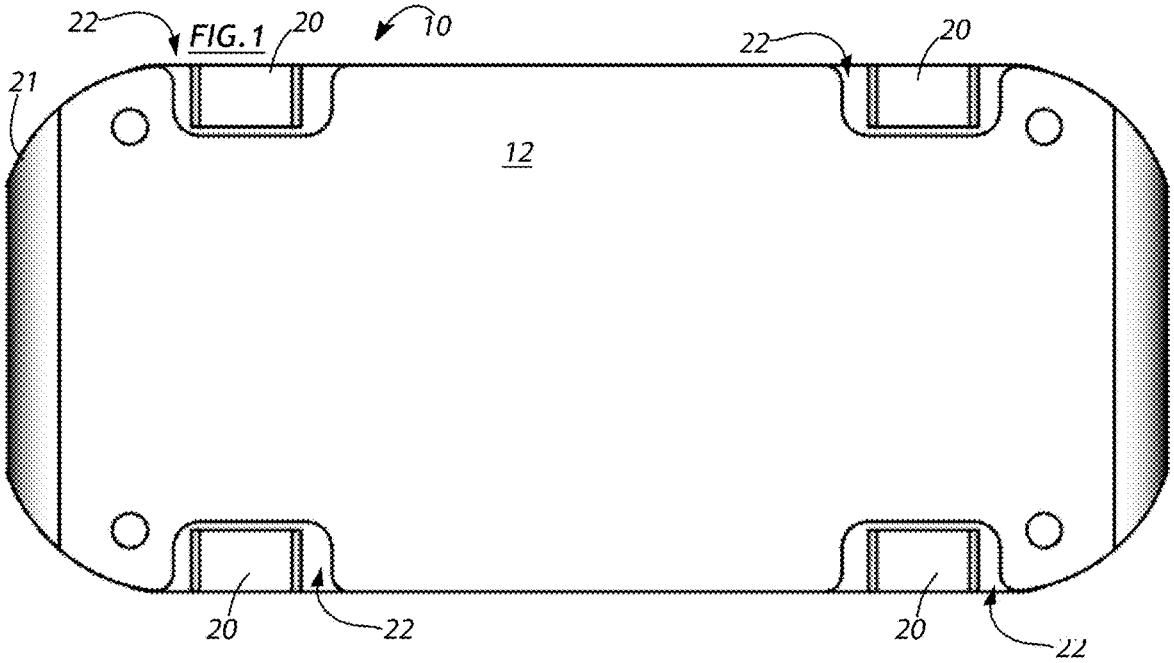
FIG. 1 shows a bottom plan view of an embodiment according to the present invention.
Figure 2:
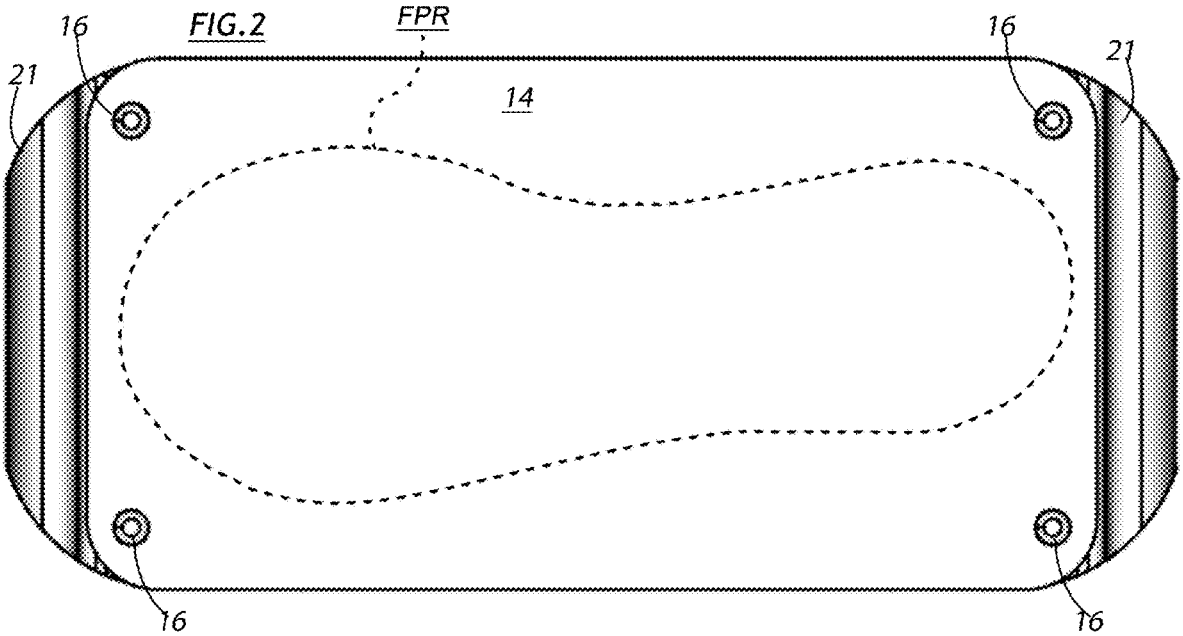
FIG. 2 shows a top plan view thereof.

10 gait assistive device
12 slidable member
14 foot placement member
16 alignment member|
17, 17*a* post alignment aperture/recess
18, 18*a* suspension member
19 spherical bushing
20 braking member

21 bumper
22 brake passageway
FPA foot placement region

Definitions

In the following description, the term involved limb refers to a weak leg, while the term uninvolved limb refers to an unaffected limb. The term gait belt refers to an over-sized strap that is wrapped about a subject's waist and secured by a buckle which is used to guide and support a subject during gait training. The term gait cycle refers to cyclic movement which includes at least two phases; the stance phase, and the swing phase. Stance phase is the lower extremity supporting the body weight as the swinging extremity passes through to progress the step forward for contact weight acceptance of the swinging limb. The cycle is then repeated. The term gait training stance refers to a stance assumed by a gait trainer or physical therapist to the side of a subject undergoing gait training, in which one of the trainer's feet is maintained ahead of the moving subject, while the other is maintained behind the subject to facilitate repeated gait cycles. The term spacer refers to any kind of member; typically a sole-shaped element that may be provided in a number of thicknesses, and affixed to the bottom of a foot or shoe worn on the unaffected side to extend leg length.

Referring generally to FIGS. 1-9, and 10, a gait assistive device 10 includes a slidable member 12 that is configured to slide across a relatively flat floor surface, a foot placement member 14, one or more suspension members 18, 18*a* between the slidable member 12 and the foot placement member 14. One or more braking members 20 are configured to contact the floor surface (FS) when a subject wearing the assistive device depresses the foot placement member 14 while shifting weight thereto. In the embodiment depicted herein, the suspension members 18 are placed circumjacent alignment members 16. The resistance of the suspension members may vary according to the weight of the subject whereby the speed of the braking when weight is applied 220 may be varied. During a gait cycle (GC), a subject causes the assistive device 10 to slide across the floor and at various points in the gait cycle the subject shifts his or her weight from side to side thus gradually relieving or gradually increasing weight applied to the foot placement member. Generally, stiffer suspension members will depress more slowly when weight is applied, while less stiff suspension members will depress 225 relatively more quickly when weight is applied. Essentially, during sliding motion of the assistive device across the floor, when sufficient weight is applied to the foot placement member 14, brakes 20 are brought downwardly into contact with the floor surface (FS) contributing to the passive braking that terminates the natural motion of a swinging leg.

Although, the braking member shown in the embodiment is a rubber bumper 20, 230 extending from the bottom side of the foot placement member 14, it can be any object having non-skid characteristics and configured to downwardly and transversely pass through or around the slidable member.

Height adjustment of foot placement member 14 may be accomplished by using different sized (length) suspension members 18, 18*a*. It is intended that any height 235 readjustment result in an unloaded foot placement member substantially parallel with the floor.

While the bottom of the slidable member is configured to easily slide, foot placement member 14 has a top surface has a non-skid rubberized and adhesive-backed material adhered to it to prevent foot slippage. A pair of straps (not shown) may 240 be employed to secure the foot atop the foot placement member.

Figure 3A:
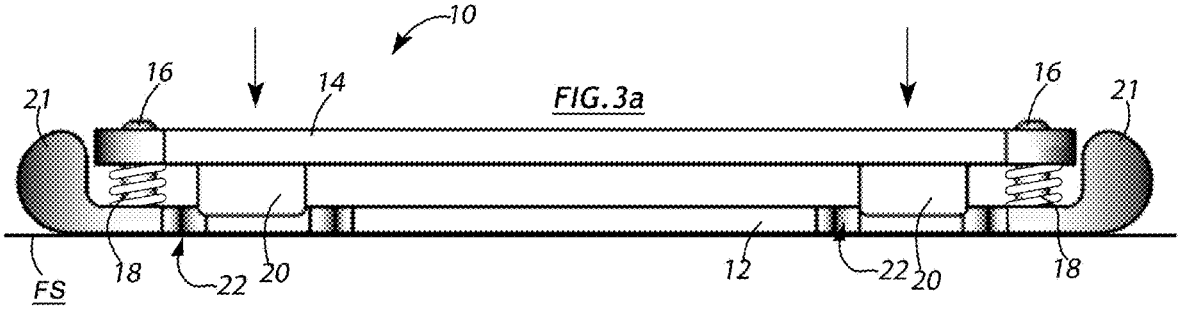
FIG. 3*a* is a first side elevation thereof.
Figure 3B:
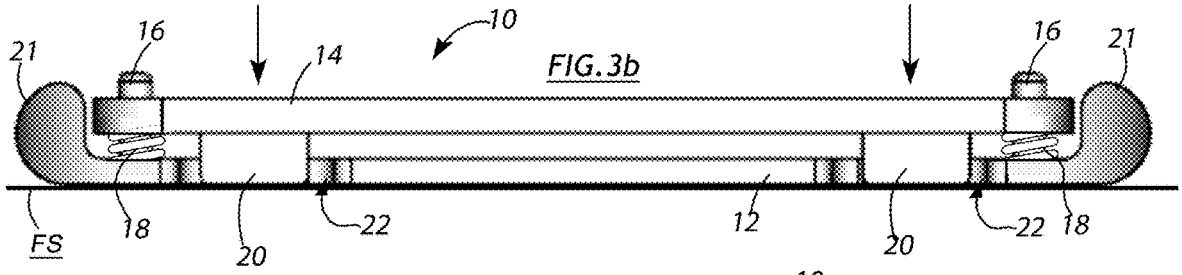
FIG. 3*b* is a second side elevation thereof.
Figure 3C:
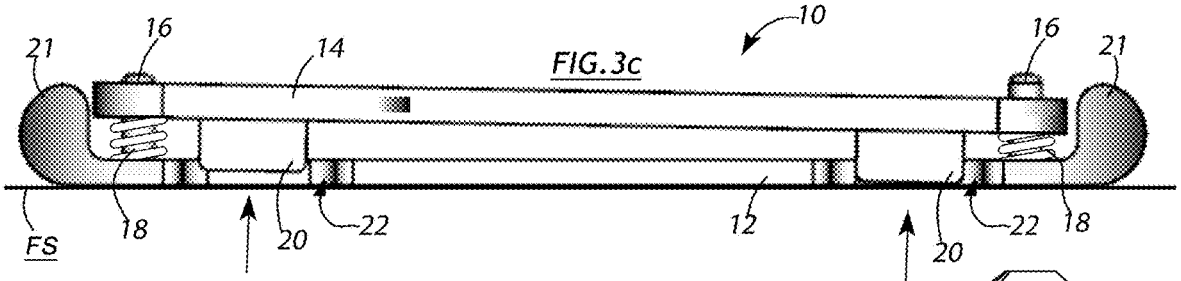
FIG. 3*c* is a third side elevation thereof.
Figure 5A:
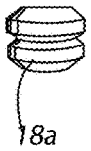
FIG. 5*a* is a side elevation of a suspension component of an embodiment according to the present invention.
Figure 4:
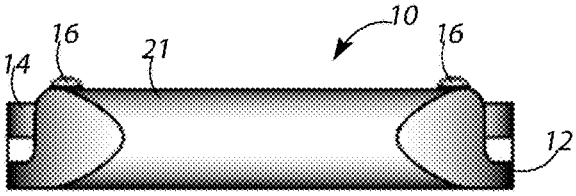
FIG. 4 is an end view thereof.
Figure 5B:
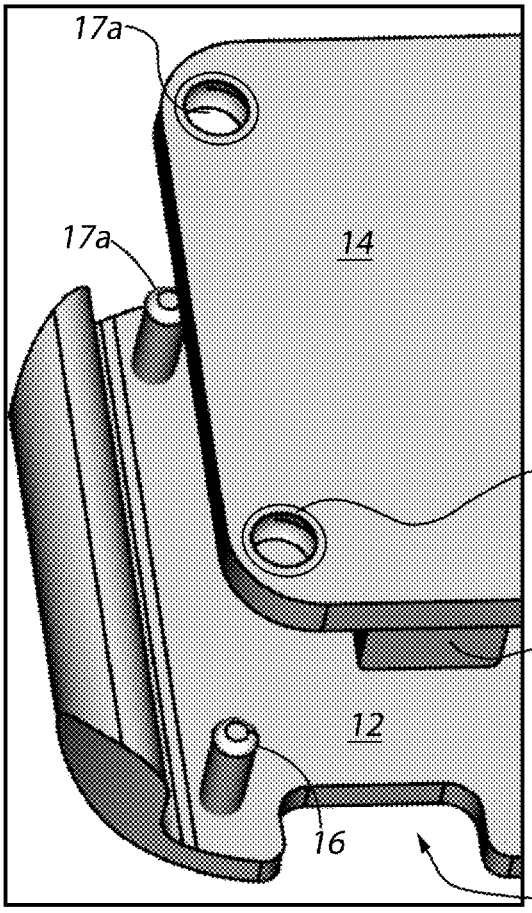
FIG. 5*b* is a partial detail view showing apertures of an embodiment configured to receive a spherical bushing.
Figure 5C:
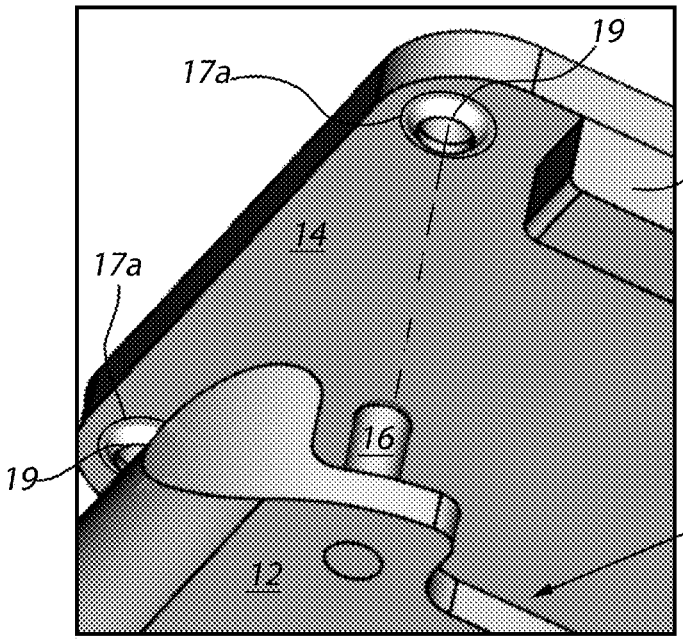
FIG. 5*c* is another partial detail view showing spherical bushing 19 placement in relation to the alignment posts 16.
Figure 6:
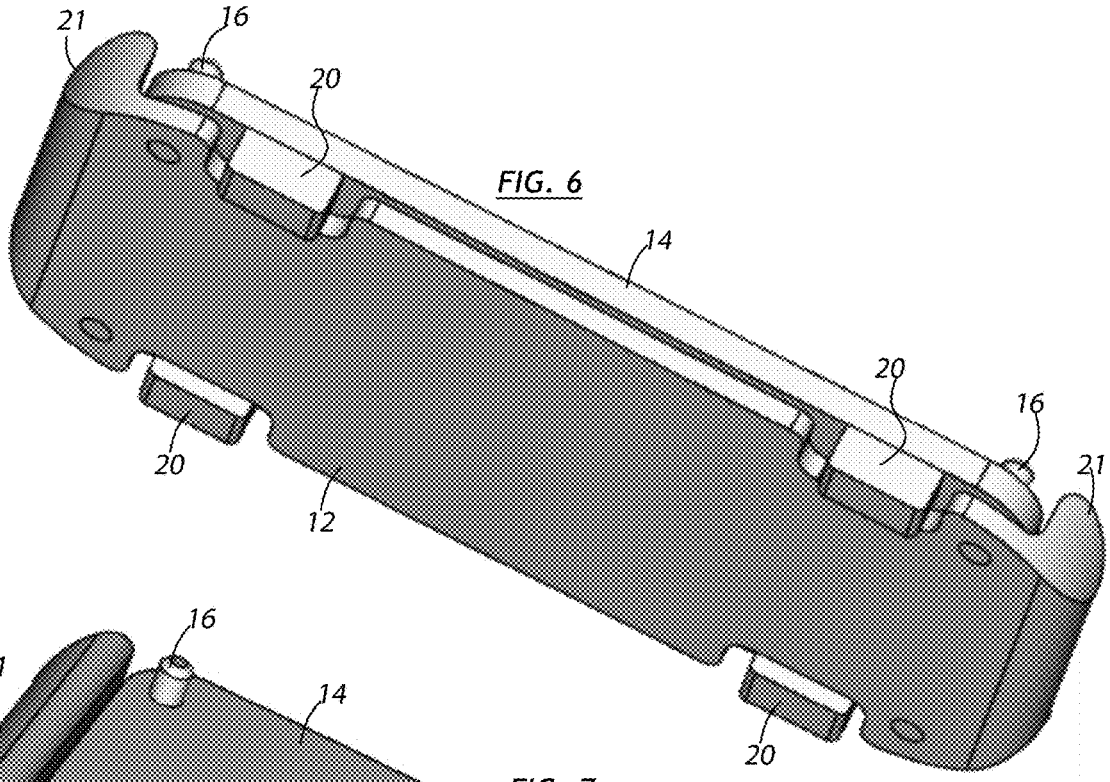
FIG. 6 is an orthographic view showing the bottom surfaces of an embodiment according to the present invention.
Figure 7:
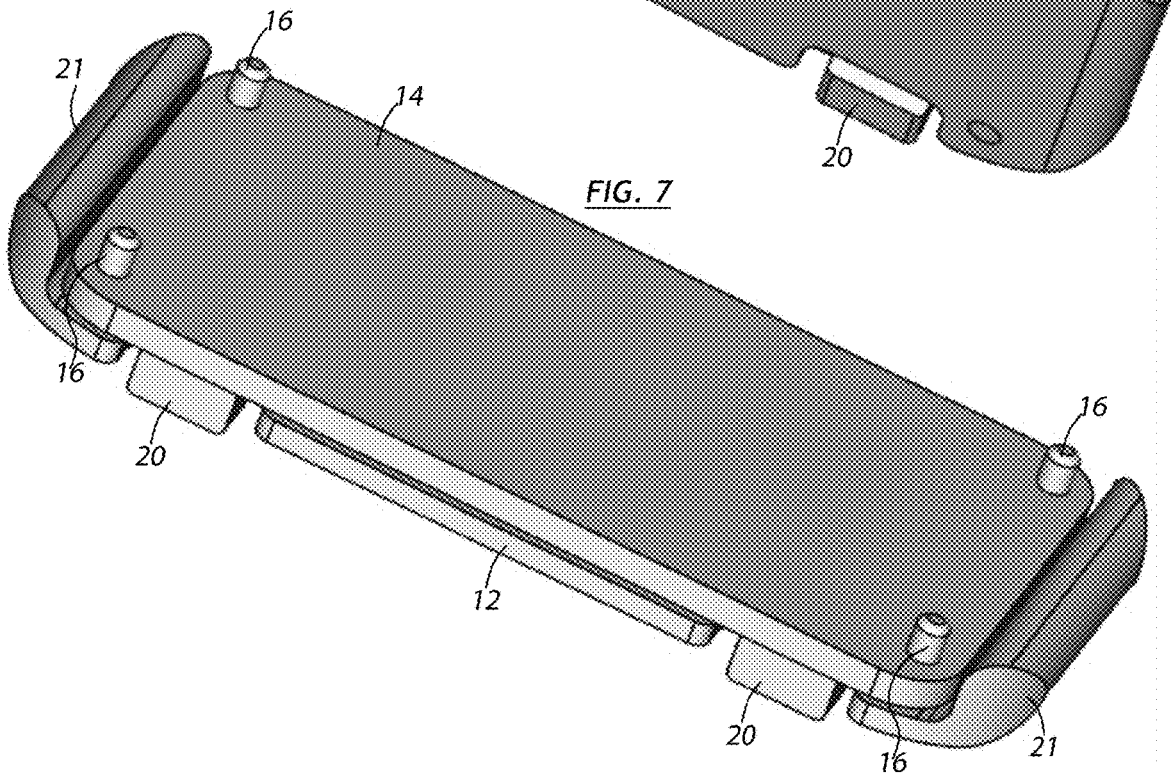
FIG. 7 is an orthographic view showing the top surfaces thereof.

FIGS. 3*a*-3*c* are side elevations of an embodiment showing depression of the foot placement member 14 and braking members 20 in relation to the slidable member 12 against a floor surface (FS). Particularly, in FIG. 3*c*, the foot placement member is seen rising at an angle. This may or may not be a desirable feature according to the 245 particular subject, the particular therapy and/or other preferences of the clinician or therapist, and may be controlled by tolerances between apertures 16*a* and alignment members 20. A relatively tight tolerance would disallow angular movement, while permitting up and down movement of the foot placement member. To enable angular; i.e., non-parallel rising or descending of the foot placement member 14—relative to the 250 slidable member 12 of the foot placement member—one or more partially spherical bushing members 19 placed within recesses 17*a* in the foot placement member 14 (see FIGS. 5*b* and 5*c*), may tilt or shift slightly within the recesses 17*a* when the angle of the alignment members 16 change.

The assistive device 12 can be donned independently by a subject with the 255 assistance of a physical therapist or a family member. The apparatus will fit to subject's foot with or without a shoe. The subject's foot is placed atop foot placement member 14. Other components such as straps (not shown) or re-sizable frame or a cradle for partially encircling a foot or shoe may be integrated with the foot placement member.

The foot placement member having suspension, offers some resistance to 260 depressing during the arc of the swing phase, giving the subject a sense of support beneath the involved limb. Accordingly, what follows is intended to be an exemplary, non-limiting description of the invention's use.

Exemplary Use with the Assistance of a Trainer (I) Standing

With or without assistance, a subject dons a shoe on both feet. The foot belonging to the subject's involved leg is secured into a re-sizable frame atop the foot placement member if present, or otherwise strapped to the center top of the foot placement member. Height adjustments are made to the foot placement member which can optionally include an attachable spacer affixed to the bottom of the shoe worn on the subject's unaffected side in order for the subject to maintain a level stance. The subject is then assisted to stand by grasping the subject's waist belt or using a gait belt.

(II) Walking

Figure 11:
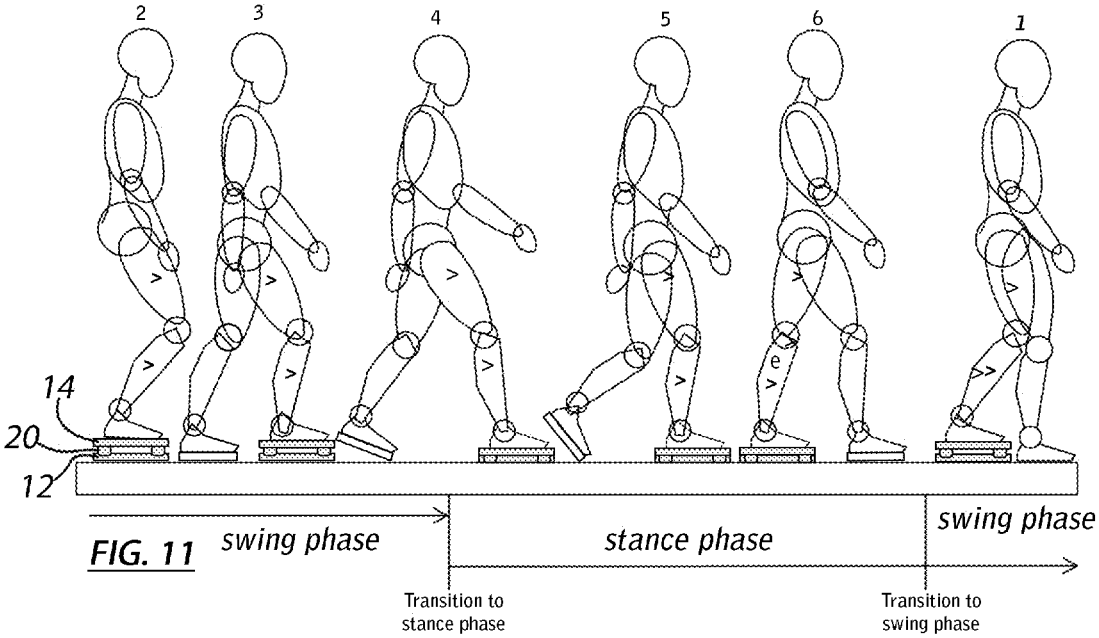
FIG. 11 is a diagrammatic view of the modified swing phase of an affected limb (denoted by >), showing a subject wearing an embodiment according to the present invention.

Once the subject is standing, weight is shifted to the uninvolved limb for support. In preparation for gait training, the trainer maintains a stance to the side of the subject in which one of the trainer's feet is in front of the subject, while the other foot is positioned behind the subject while maintaining contact with the gait belt, allowing the trainer to support the subject where needed through repeated gait cycles. As shown in FIG. 11 (2-6), when the subject swings/rolls the involved limb forward, the foot placement member slightly lifts FIG. 11 (2-3), allowing the involved limb to be advanced. The trainer can assist the subject's pelvic rotation by guiding the subject via the gait belt (not shown) as required. The trainer constantly repositions himself according to the subject's movement while giving verbal instruction if required. Once the step of the involved limb completes, the trainer assists in shifting weight to the involved leg. As the weight is shifted, the foot placement member accepts the weight, the springs compress FIG. 11 (4-5), and the foot placement member is lowered until the braking members 20 are forced into contact with the floor FIG. 3*b* terminating any further movement. The involved leg becomes the stance leg FIG. 11(6), and awaits the subject's weight shift to the uninvolved leg, and a repeat of the gait cycle as shown in FIG. 11 (1). If the subject requires bracing of the 290 involved leg to prevent buckling, the trainer can block the subject's knee by using a hand held against the subject's knee, or the trainer may place his or her knee against the subject's knee. Once the swing phase of the involved leg is complete, the process is repeated until the uninvolved leg has once again transitioned to the stance leg.

Exemplary Use without Assistance from a Trainer (I) Standing

With or without assistance, a subject dons a shoe on both feet. The foot belonging to the subject's involved leg is secured into the re-sizable frame if present, or otherwise strapped to the center top of the foot placement member 14. Height adjustments are made to the foot placement member which can include using a variety of suspension members (18, 18*a*), or which can optionally include an attachable spacer affixed to the bottom of the shoe worn on the subject's unaffected side in order to compensate for the difference in leg length to enable the subject to maintain a level stance. The subject next brings themselves to a standing position that may be accomplished with the use of a hand rail, cane, walker, or other assistive device.

(II) Walking

Figure 8:
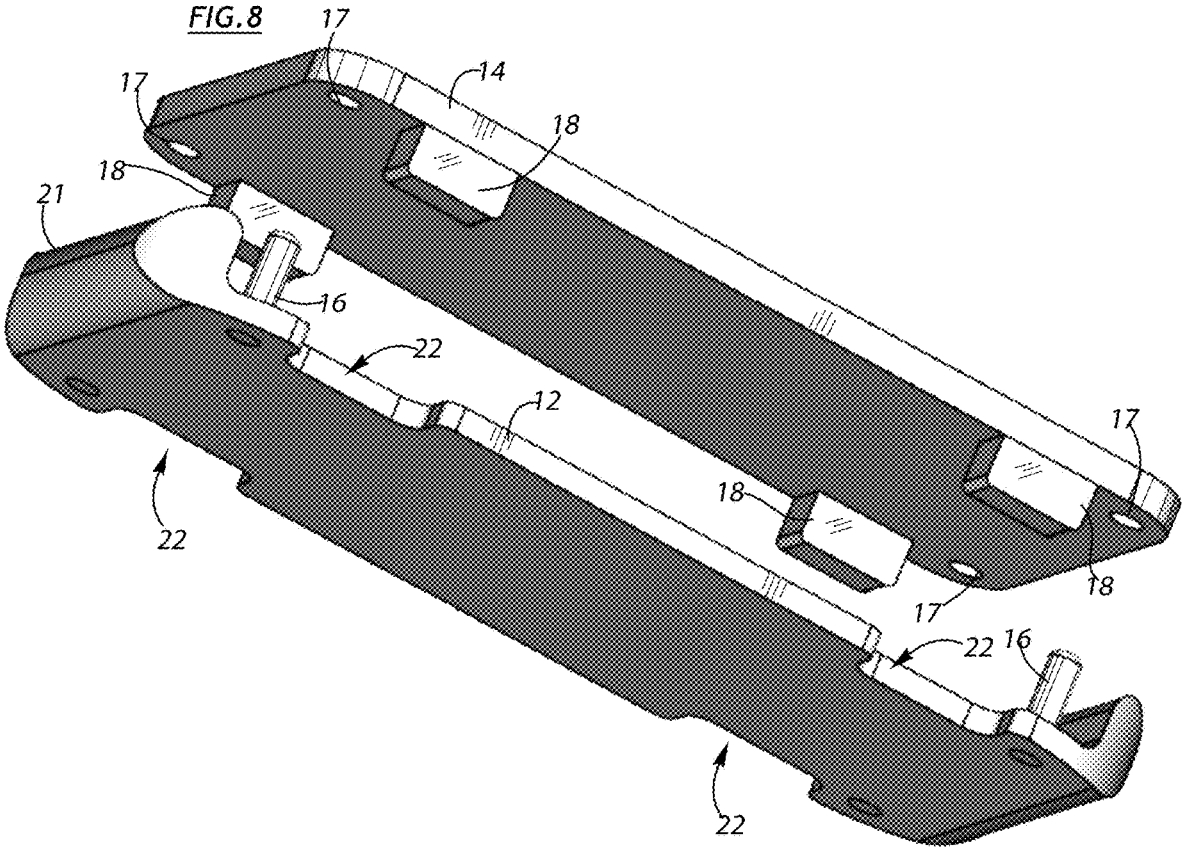
FIG. 8 is an orthographic exploded view showing the bottom surfaces of an embodiment according to the present invention.
Figure 9:
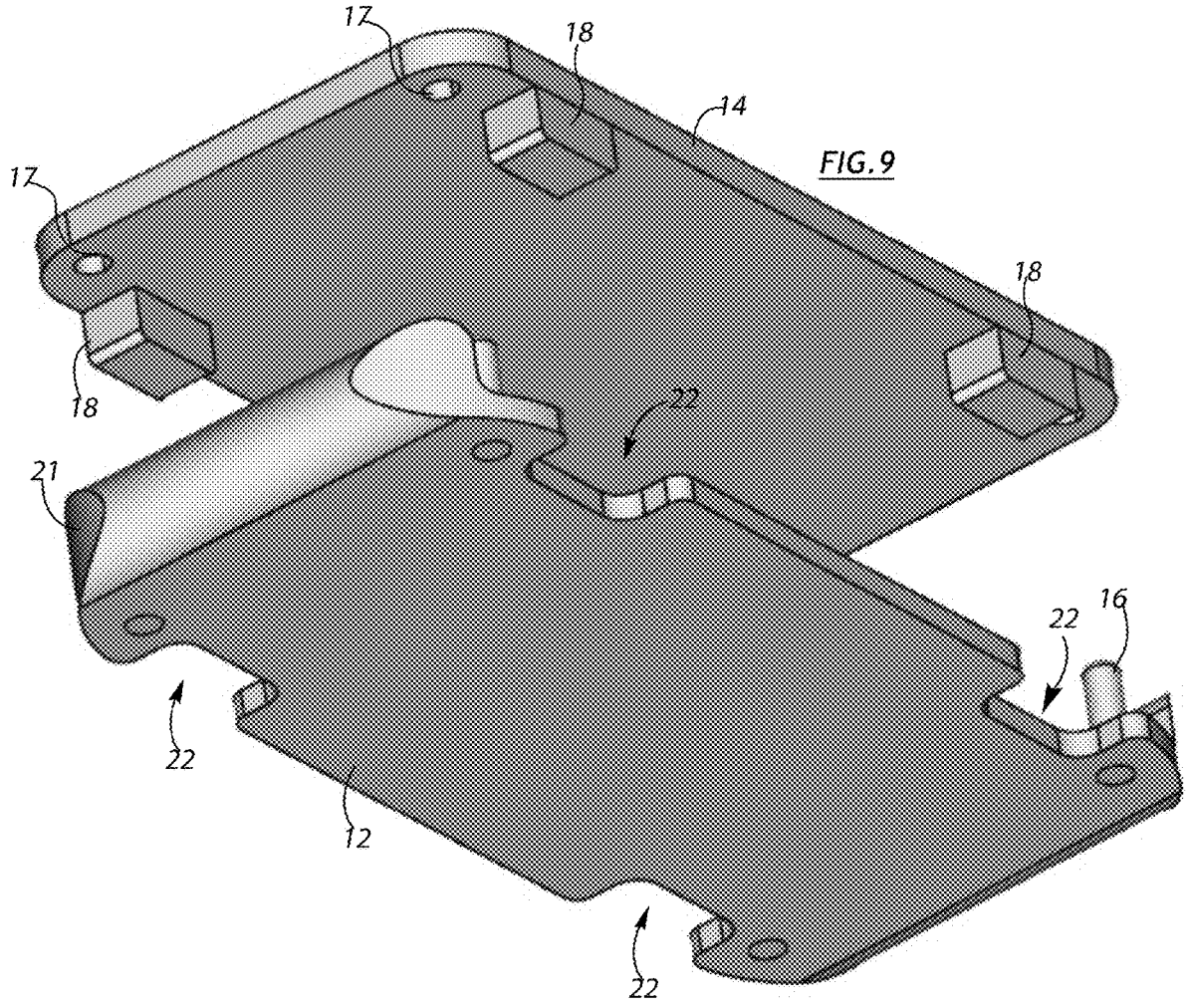
FIG. 9 is another orthographic exploded view showing the underside of slidable 175 assembly 12 and foot placement member 14.
Figure 10:
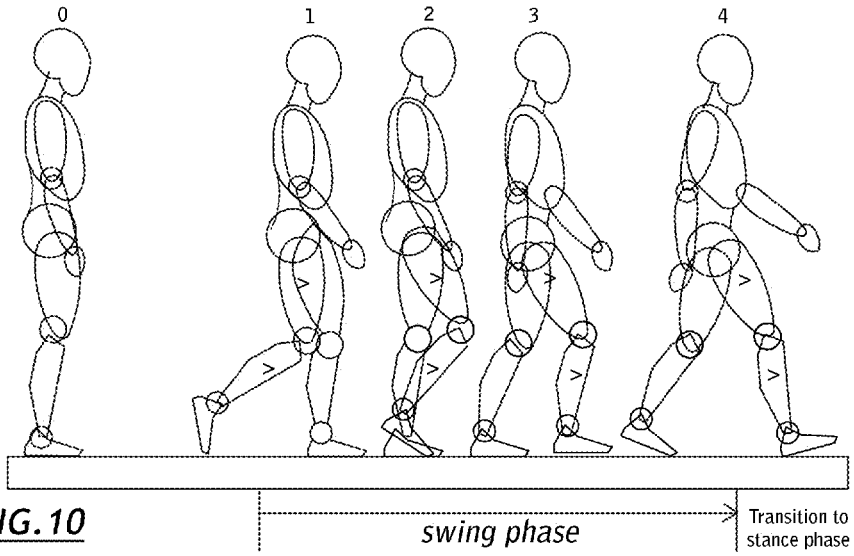
FIG. 10 is a diagrammatic view showing a typical unassisted gait process.

Once the subject is in the standing position, they can shift their weight to the uninvolved leg defining the stance leg, and begin the process of swinging the involved leg forward. Initially, as weight shifts away from the involved leg, the foot placement member rises slightly FIG. 8 (2-3), and permits the involved leg to swing/roll forward. As weight is shifted back to the involved leg, the leg is brought down, the foot placement member depresses FIG. 8 (4), and the bumpers are forced into contact with the floor braking any foot placement member movement. The involved leg is now the stance leg and the swing cycle can recommence with the uninvolved leg FIG. 8 (5). Once the uninvolved leg is fully 315 in stance phase, the swing phase recommences with the involved leg as shown in FIG. 8 (1). In cases where the subject has a weak leg, and insufficient control of the knee, a leg brace can be supplied by a health practitioner to prevent the involved leg from buckling when weight is applied thereto.

While the invention has been described by the particular embodiments given, it is not intended that the scope of the invention be limited to the particular forms set forth. While the foot placement member of the particular embodiment is depicted as generally planar, it is conceivable that a foot placement member may possess a central indentation for the placement of a foot therein, so as to bring the bottom of a foot; or the bottom of a worn shoe, in even closer communication with the floor. Accordingly, the invention is intended to cover such alternatives, modifications, and equivalents as may be included within the spirit and scope of the invention as defined by the appended claims.

What is claimed is:

1. An apparatus for gait training hemiparetic subjects, comprising:

an assembly including:

a slidable member including a front side, a back side and left and right sides, the slidable member configured to directly contact and slide across a floor surface;

a foot placement member disposed atop the slidable member;

a foot placement region disposed within bounds of the foot placement member and between the left and right sides of the slidable member;

at least one suspension member;

at least one downwardly depressible braking member configured to downwardly depress by sufficient weight applied atop the foot placement region of the foot placement member; and, the apparatus is configured to continuously and unimpededly cycle from a freely slidable state where the depressible braking member is not frictionably engaged with the floor surface to a braking state where the depressible braking member is frictionably engaged with the floor surface solely by the reciprocal application of sufficient weight to the foot placement region.

2. The apparatus according to claim 1 wherein the weight is applied transversely relative to the foot placement member.

3. The apparatus according to claim 1 wherein the foot placement region is capable of translation to a parallel position or non-parallel position relative to the slidable member during the cycle to and from the freely slidable state to the braking state.

* * * * *